US009533856B2

(12) United States Patent
Spelich et al.

(10) Patent No.: US 9,533,856 B2
(45) Date of Patent: Jan. 3, 2017

(54) SYSTEM FOR MEASURING PAYOUT LENGTH OF AN ELONGATE MEMBER

(71) Applicant: Spartan Tool L.L.C., Mendota, IL (US)

(72) Inventors: John Spelich, Peru, IL (US); Ross Wilson, Utica, IL (US); Kevin T. Dineen, Bartlett, IL (US); Hannah E. Thomas, Arlington Heights, IL (US); Matt C. Anderson, Hampshire, IL (US)

(73) Assignee: Spartan Tool L.L.C., Mendota, IL (US)

( * ) Notice: Subject to any disclaimer, the term of this patent is extended or adjusted under 35 U.S.C. 154(b) by 0 days.

(21) Appl. No.: 14/281,439

(22) Filed: May 19, 2014

(65) Prior Publication Data

US 2015/0329313 A1 Nov. 19, 2015

(51) Int. Cl.

*B65H 75/38* (2006.01)
*B65H 75/44* (2006.01)
*B65H 61/00* (2006.01)

(52) U.S. Cl.

CPC ..... *B65H 75/44* (2013.01); *B65H 61/00* (2013.01); *B65H 75/4481* (2013.01); *B65H 75/4484* (2013.01); *B65H 2701/33* (2013.01)

(58) Field of Classification Search

CPC ..... B65H 75/4484; B65H 2551/13
USPC ..... 242/390, 390.1, 563, 563.2
See application file for complete search history.

(56) References Cited

U.S. PATENT DOCUMENTS 5,070,907 A 12/1991 Salecker
5,199,129 A 4/1993 Salecker et al.
5,239,724 A 8/1993 Salecker et al.
5,309,595 A 5/1994 Salecker et al.
5,329,662 A 7/1994 Salecker
5,333,448 A 8/1994 Salecker
5,335,388 A 8/1994 Salecker
5,364,240 A 11/1994 Salecker
5,379,476 A 1/1995 Salecker
5,507,062 A 4/1996 Salecker
6,655,228 B1 12/2003 Margherio et al.
6,883,743 B2 4/2005 Schellekens
7,156,585 B2 1/2007 Wang et al.
7,518,526 B2 * 4/2009 Newman ..... E21B 19/00 166/53

(Continued)

OTHER PUBLICATIONS

Spartan 746 Water Jet Owner's Manual, 74617000 (Rev.-) Oct. 30, 2013, www.spartantool.com_filebin_productmanual_746 & 746LP manual Oct. 30, 2013, @ 2013 Spartan Tool LLC.

*Primary Examiner* — Sang Kim
(74) *Attorney, Agent, or Firm* — Brinks Gilson & Lione

(57) ABSTRACT

A system for calculating and displaying a length of payout of an elongate member upon a reel is provided. The system includes a rotatable reel wherein rotation causes the member to be either paid out from or withdrawn toward the reel. A motor is provided and is configured to selectively transmit torque to the reel to urge rotation of the reel. A transmission is in operative connection between the motor and reel, the transmission is configured to transfer torque from the motor to the reel. A sensor is operatively engaged with the reel, the sensor being configured to sense movement of the reel and generate a signal representative of the sensed movement of the reel. A controller that is configured to receive the signal from the sensor, and calibrated to determine a length of hose that is paid out from the reel based upon the signal.

13 Claims, 6 Drawing Sheets

(56) References Cited

U.S. PATENT DOCUMENTS

| | | | | |
|---|---|---|---|---|
| 8,336,800 | B1 * | 12/2012 | Lopez | B65H 75/4407<br>137/355.2 |
| 2002/0125014 | A1 * | 9/2002 | Dearing | E21B 19/22<br>166/384 |
| 2006/0071116 | A1 * | 4/2006 | Quenneville | B65H 75/425<br>242/557 |
| 2012/0097783 | A1 * | 4/2012 | Pack | B65H 75/425<br>242/416 |

* cited by examiner

SYSTEM FOR MEASURING PAYOUT LENGTH OF AN ELONGATE MEMBER

TECHNICAL FIELD

This disclosure relates to machines that selectively unwind, or pay out, and elongate member for use in a work function and also selectively rewind the elongate member upon the reel. For example, jetters, such as hydro jetters, are machines that are configured to include an elongate hose that is wound upon a reel. The hose is configured to be unwound from the reel by the user to allow the hose to be directed into a sewer, a pipe, a conduit, or a similar structure to allow the hose to be used for remote inspection of the sewer (or the like). The hose may have a camera, a tool, and/or may be configured to direct a supply of high pressure liquid from an extended end of the hose to perform a task, normally to assist with unclogging the sewer, or for remote visual inspection of the sewer, or the like.

BRIEF SUMMARY

A representative embodiment of the disclosure is provided. The embodiment includes a system for paying out and withdrawing an elongate member. The system includes a rotatable reel that is configured to receive and retain a length of a flexible elongate member in a coiled fashion thereon, wherein rotation of the reel causes the flexible elongate member to be either paid out from the reel or withdrawn toward the reel, depending upon a direction of rotation of the reel. A motor is provided and is configured to selectively transmit torque to the reel to urge rotation of the reel. A transmission is in operative connection between the motor and reel, the transmission is configured to transfer torque from the motor to the reel. A sensor is operatively engaged with the reel, the sensor being configured to sense movement of the reel and generate a signal representative of the sensed movement of the reel. A controller that is configured to receive the signal from the sensor, the controller is calibrated to determine a length of hose that is paid out from the reel based upon the signal.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

Turning now to FIGS. 1-7, a system 10 for paying out and withdrawing an elongate member is provided. The system 10 may be used with any device where an elongate member 1000 (such as a hose) is cyclically paid out and then rewound onto a reel 100. More specifically, the system 10 may be used with a device or machine where an elongate member 1000 is paid out through a pipe or conduit, a sewer or another elongate structure where the elongate member (and specifically the extended end 1001 of the elongate member 1000) is not visible or accessible when the elongate member 1000 is paid out. In some embodiments, the system 10 may be used in conjunction with a machine that controls the rotation of a reel 100 (or another structure to selectively payout or withdraw an elongate member 1000) as well as other functionality of the elongate member 1000, such as controlling fluid flow through the elongate member 1000 (such as when it is a hose) controlling operation of a camera on an extended end portion 1001 of the elongate member 1000 (or on another location thereupon), or controlling one or more tools that are remotely operable upon the elongate member 1000.

The measurement of the length of payout of the elongate member 1000 (and subsequent withdrawal) may be beneficial for many reasons, such as knowledge of the location of the extended end 1001 of the elongate member 1000 within its enclosure (i.e. for an indirect indication that the elongate member 1000 is properly positioned for the task, or to indirectly determine the location of the extended end 1001 of the elongate member 1000, i.e. in situations where the extended end 1001 must be accessed when with the elongate member 1000 in a paid out condition).

Figure 1:
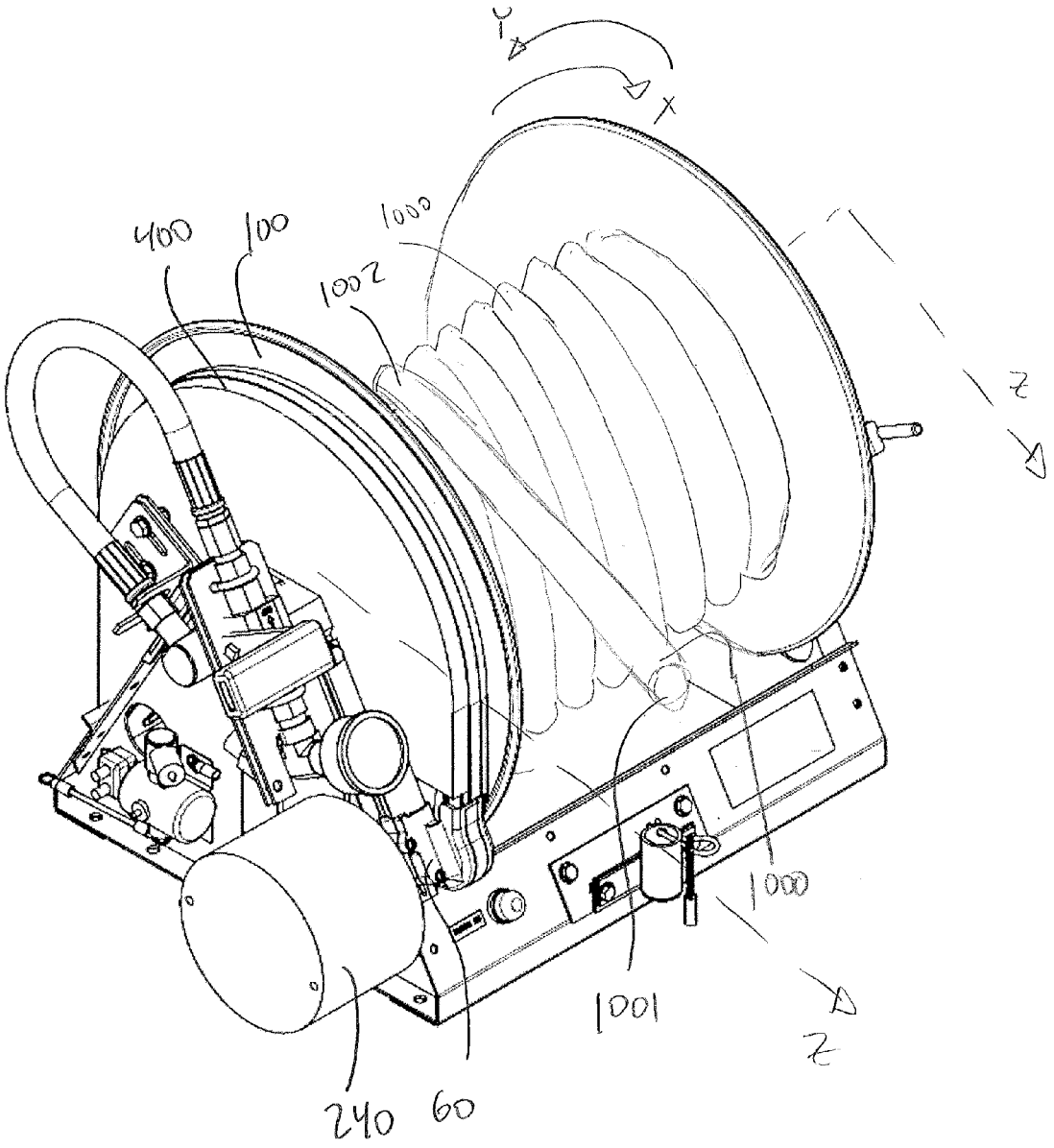
FIG. 1 is a perspective view of the system for measuring a payout distance of an elongate member stored upon a reel, with a portion of the elongate member paid out from the reel.
Figure 2:
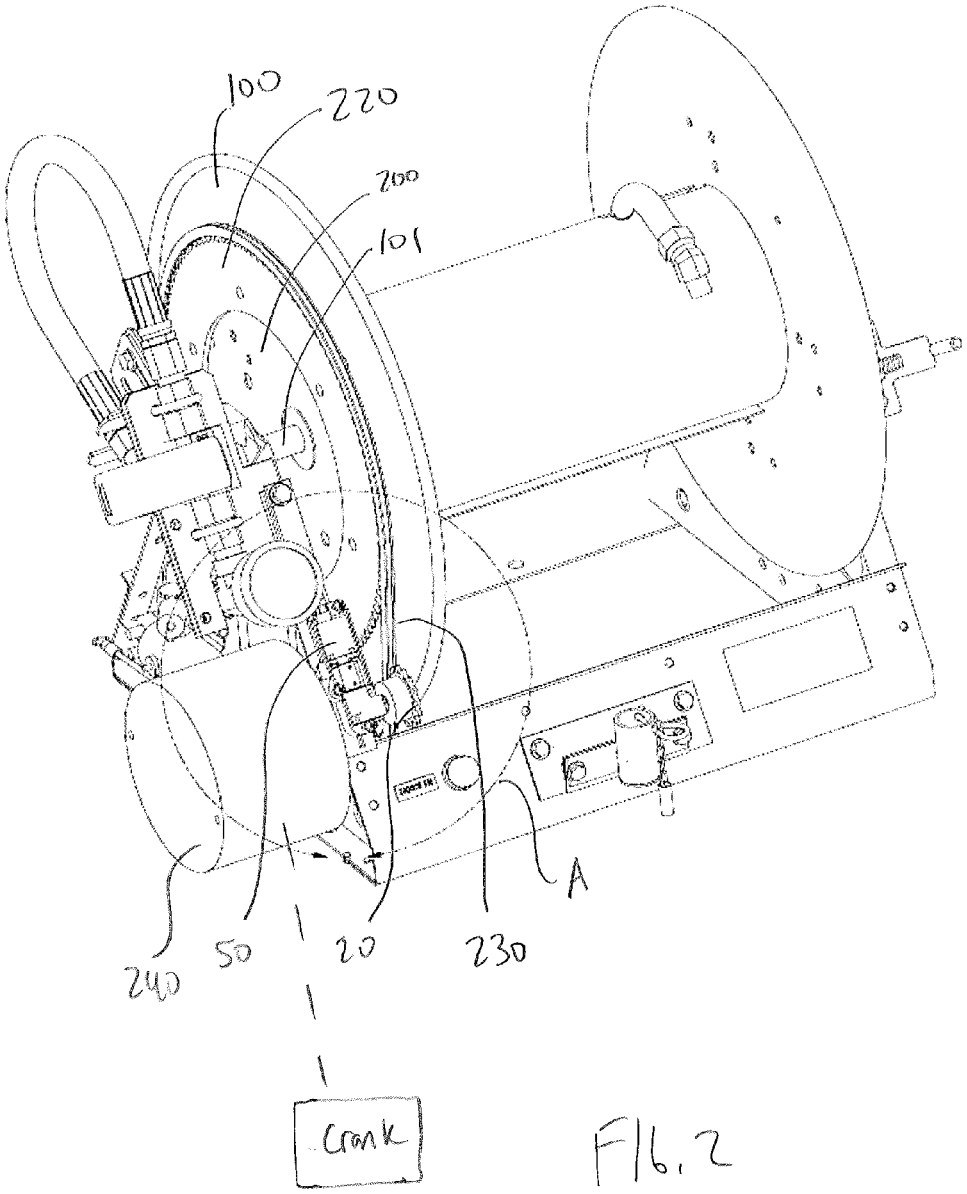
FIG. 2 is the view of FIG. 1 showing with a transmission cover removed, and with the elongate member removed.
Figure 3:
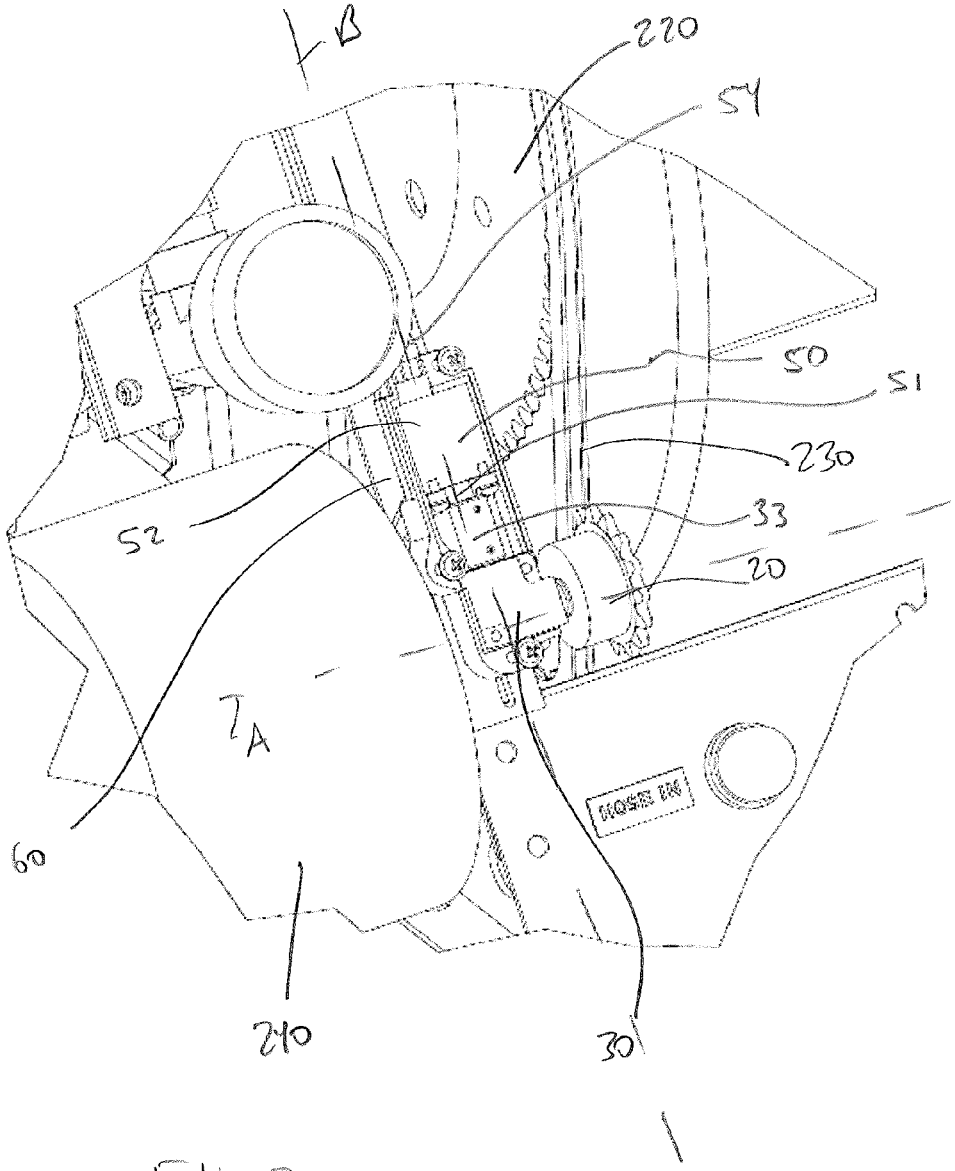
FIG. 3 is a view of detail A of FIG. 2.
Figure 4:
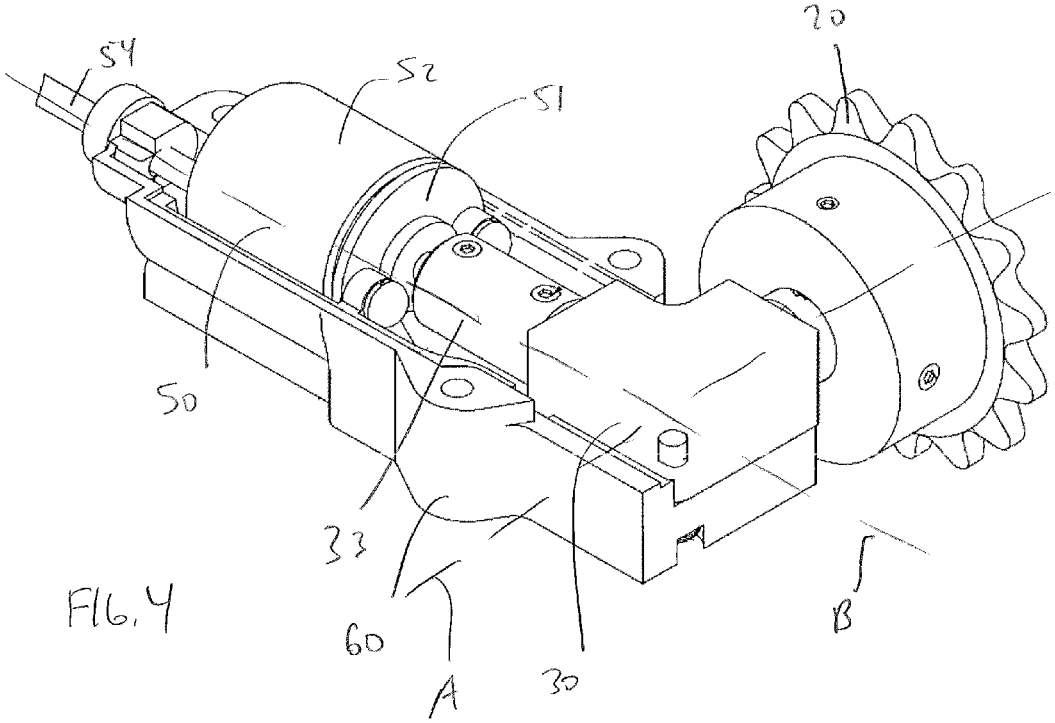
FIG. 4 is a perspective view of the input gear and the encoder system.
Figure 5:
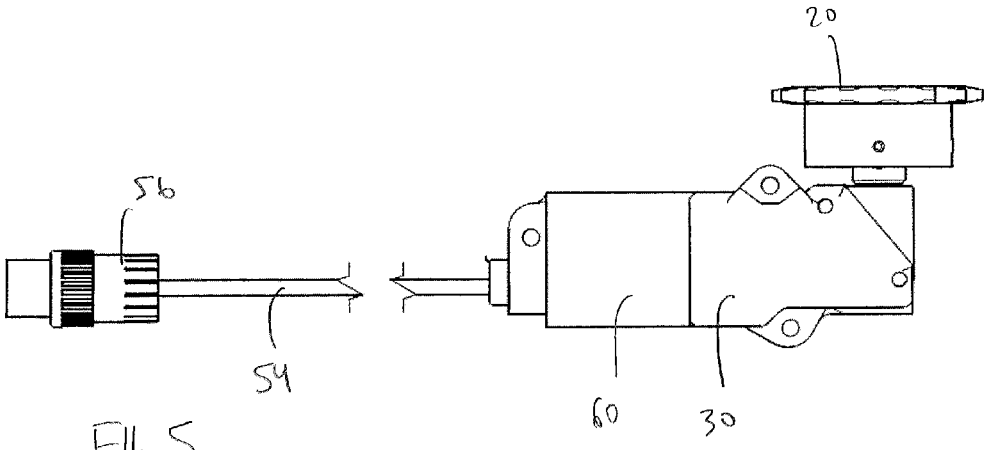
FIG. 5 is a top view of FIG. 4.
Figure 6:
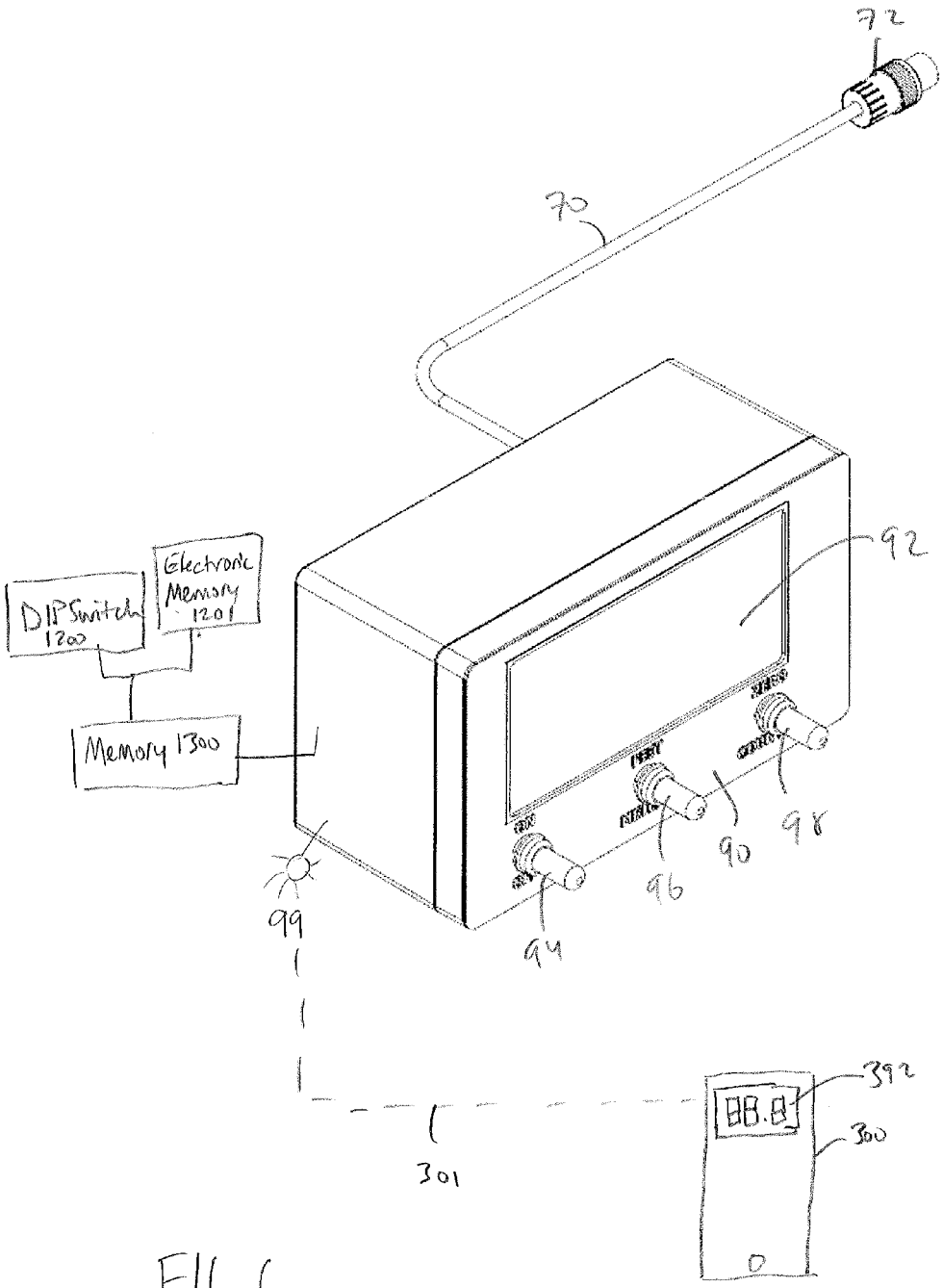
FIG. 6 is a schematic view of a display and an optional remote display.
Figure 7:
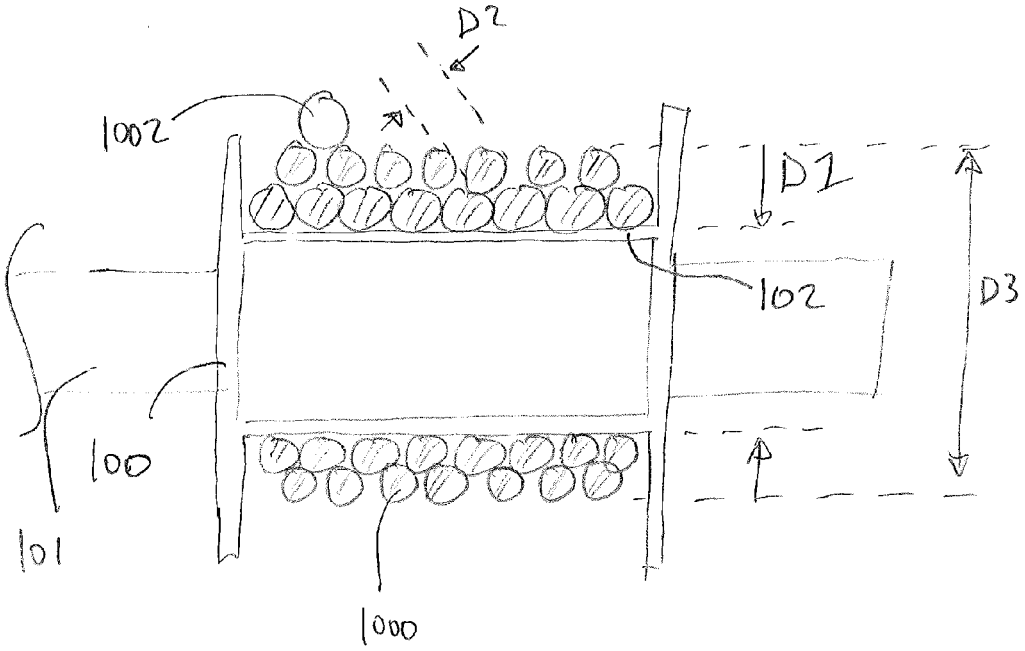
FIG. 7 is a sectional view of section Z-Z of FIG. 1.

The system 10 may be connected directly or indirectly to a rotatable reel 100, such that the system 10 measures the amount of rotation of the reel 100, both in the "paying out" direction X, and in the "reeling in" direction, Y, when the reel 100 is rotated by a transmission 200. The transmission 200 may include a gear train between a motor shaft 240 and the reel shaft 101, or in some embodiments meshed gears on both shafts, or, alternatively, another torque transmission structure, which allows for a change of rotational speed between the motor shaft 240 and the reel 100. Alternatively, torque could be transferred from the motor 240 to the reel 100 using other structures known in the art, such an endless member, such as a belt or chain drive (230, FIGS. 2, 3). In some embodiments, the reel 100 may include a shaft 101 that rotates along with the reel 100 (either directly with the reel 100, i.e. in situations where the shaft 101 itself provides torque to spin the reel 100, or in other embodiments, the shaft 101 may be driven by the reel 100, such as when the reel 100 receives torque from an input (such as a chain or belt drive 230, which is driven by a motor 240 and motor shaft). In some embodiments, a gear (not shown) may be provided upon the shaft 101, which allows the shaft to receive torque from the transmission 200 (and ultimately from the motor 240) to rotate the reel 100. In some embodiments, the gear 220 may be meshed with the transmission 200 to allow torque from the transmission 200 to be applied to the shaft 101 (and therefore the reel 100). In other embodiments where the transmission 200 (or the motor shaft 240) applies torque directly to the reel 100, the gear 220 is an output for the reel 100 and interacts directly or indirectly with the sensor 50, such as through an input 20 meshed to the gear 220 on the shaft 101, or through an intermediate torque transfer arrangement, such as a chain or belt 230 that transfers torque from the shaft 101 remotely to the input 20. As shown in FIG. 1, a cover 400 may be provided over all or a portion of the transmission 200, as well as the operative connection between the transmission 200, the reel 100, and the input 20.

In other embodiments, a hand crank or other input device may be disposed with respect to the transmission to allow the user to manually (or with assistance) rotate the hand crank and therefore supply torque to the reel 100.

The system 10 may include an input 20, such as a gear or sprocket or belt or chain pulley, or another suitable structure to receive torque thereon, with the torque received being representative of the rotation of the reel 100, and a sensor 50 that is operatively engaged with the input 20. In some embodiments, the input 20 and sensor 50 may be directly connected, such as disposed upon opposite ends of a shaft. In other embodiments, the input 20 and the sensor 50 may be indirectly connected, such as through a gear box 30. In some embodiments, the input may be disposed to rotate along a first longitudinal axis A that is perpendicular (or at another angle with respect to) to the rotational axis B of the sensor 50. The gear box 30 may include a suitable gear train to transfer torque from the input 20 to the sensor 50 and allow the position and orientation of the sensor 50 to be different from the input 20, such as for space considerations, or rotational speed reasons, or do to the rotational characteristics of the sensor 50. In other embodiments, the sensor 50 and the input 20 may be arranged with other arrangements, such as along parallel longitudinal axes with meshed gears disposed therebetween to transfer torque from a shaft with the input to a shaft with the sensor 50, or with other arrangements that would be understood by those of skill in the art to be possible with a thorough review of the subject specification and drawings.

The sensor 50 may include a fixed portion 52 and a rotatable portion 51. The fixed portion 52 may be supported by the gear box 30, or an extension from the gear box 30, or by another portion of the machine that includes the rotatable reel 100 and related components. The rotatable portion 51 may be rotatably connected with the input 20, such that rotation of the input 20 ultimately results in rotation of the rotatable portion 51. In some embodiments, the rotatable portion may be fixed to a coupler 33 (either within the gearbox 30, or outside of the gear box 30), which is in-turn fixed to the input 20, or fixed to intermediate structures that are ultimately fixed to the input 20 (and either disposed within the gearbox 30 or in another enclosure). In some embodiments, the sensor 50 may be a rotary encoder, and in some embodiments a quadrature encoder. In other embodiments, other types of rotary encoders may be used.

The sensor 50 is configured to measure the rotation of the input 20 (due to the direct or indirect connection therebetween), and therefore indirectly measure the rotation of the reel 100 based upon the operative engagement between the input 20 and the reel 100, as discussed herein. The sensor 50 may provide a signal representative of the rotation of the reel 100 to a controller 90 (via one or more cords 54, 70, connected with connectors 72, or in other embodiments wirelessly) that may be disposed within a display 92 (or at another location upon the machine, or remote from the machine via a wireless connection, as discussed herein) that provides an indication of the length of elongate member 1000 that is paid out from the reel 100 (based upon the sensed rotation of the sensor 50 and a correlation between the sensed rotation of the sensor 50 and the hose 1000 payout.

The display 92 may be a digital display or an analog display and may be configured to display the length of the elongate member 1000 that is paid out from the reel 100. The controller and/or the display may be configured to provide a signal (through a wire or other direct connection, or through a wireless network, such as Wifi, Bluetooth, or another wireless band known and available in the art, shown schematically in FIG. 6 with antenna 99 and a signal 301) that is representative of the length of the elongate member 1000 that is paid out from the reel 100, which can be displayed remotely such as on a user's smartphone, tablet, laptop (shown schematically in FIG. 6 as element 300, with display 392), or on a remote location of the machine, such as at a location on the machine where a display of the extended end 1001 of the elongate member 1000 is provided (visual display, or sensed parameters from the extended end 1001, or the like) and/or includes controls for operating the reel 100 and/or other associated controls for the machine.

The controller 90 may be configured to calculate the length of an elongate member 1000 that is paid out from the reel 100 (or withdrawn back onto the reel 100, depending upon the direction of the rotation of the reel 100, X or Y, discussed herein) with receipt of the signal from the sensor 50 representative of the rotation of the reel 100 and with additional information programmed into the controller, or retained within the controller 90. Specifically, the length of the elongate member 1000 that is paid out from the reel 100 (or withdrawn back onto the reel 100) per rotation of the reel 100 is a function of the "working diameter" of the reel 100 (FIG. 7, D3), i.e. the diameter of the reel 100 (FIG. 7, D1) and the thickness (FIG. 7, D2) of any coils of elongate member 1000 disposed upon the reel 100 that the elongate member 1000 to be paid out from the reel 100 (or just rewound upon the reel 100) rests upon. In some embodiments, the "working diameter" (D3) of the reel 100 may be a function of the diameter (D1) of the reel 100 itself, the diameter of the elongate member 1000 (D2), and the number of turns of the elongate member 1000 that is disposed upon the reel 100 between the portion of the elongate member 1000 that is just to be paid out (FIGS. 1, 7; 1002) (or just rewound upon the reel 100) and the reel 100 itself.

In some embodiments, the diameter of the elongate member 1000 (such as a hose) may be inputted into and saved by the controller 90 (either at the factory when the controller is programmed, or inputted by the user when a specific elongate member is installed onto the reel 100), because the length of elongate member 1000 paid out from the reel 100 per rotation of the reel 100 is a function of the diameter of the elongate member, as well as the number of turns of the elongate member 1000 currently disposed upon the reel 100.

In some embodiments, some or all of the data used by the controller 90 to calculate the payout length of the elongate member 1000 may be "saved" within the controller by various common storage components 1300 (which may be mechanical, electrical, or electromechanical, such as based upon the position of one or more DIP switches 1201 (or other electromechanical input devices), or within the controller's electrical memory 1201.

For example, the controller logic may look to the position of various DIP switches 1200 for various settings that depend upon the type (diameter) and length of an elongate member 1000 used upon the reel 100. The use of DIP switches 1200 allow for the system 10 to be easily retrofitted to an existing machine, and allow for the elongate member 1000 to be changed upon the reel 100 (between a number of previously programmed alternative elongate members 1000) without needing to reprogram the controller's logic. For example, one or several DIP switches 1200 may be provided to allow the user to input (based upon the position of one or several DIP switches) the length of the elongate member 1000 (between several prior identified lengths) and the diameter of the elongate member 1000 (between several prior identified diameters). Alternatively, the variables regarding the elongate member 1000 necessary for payout length calculation may be stored within the controller's "electronic memory," which may be an nonvolatile or savable memory system known to those of ordinary skill in the art (such as, flash memory, or the like).

By way of example, the controller 90 may be programmed to allow for several different lengths (and/or diameters) of elongate member 1000 and the position of one or multiple DIP switches 1200 may be predetermined for each length (diameter), such that the user may reference adjust the one or more DIP switches based upon the selected length (diameter) of the elongate member 1000. The controller 90 "reads" the position of the DIP switch and calculates the payout length based upon the length (diameter) of the elongate member 1000 indicated by the DIP switch position. Because the DIP switches mechanically remain in the selected position, the use of DIP switches serve as a "memory" for the controller of the selected length/diameter of the elongate member 1000 (and potentially the reel 100) (as well as potentially other parameters of the elongate member 1000 or reel 100) that may minimize the need for other types of memory associated with the controller 90 for this information, which may assist in retrofitting a controller 90 for an existing machine to also control the system 10 and provide a signal to a display of the hose payout length. In other embodiments, this information may be inputted into the controller through other means, such as electrical inputs (and stored in the controller's memory), or a keyboard or the like, which may be in communication with the electronic memory discussed above.

In some embodiments, the controller 90 may have other inputs or functionality, such as a zeroing function. The zeroing function may be used to recalibrate the controller 90 to indicate that no portion of the elongate member 1000 is currently paid out from the reel 100. The zero functionality might be beneficial when an elongate member 1000 is replaced, or when maintenance is performed on the system 10, to allow for the initial length of elongate member 1000 to be calibrated. The zeroing function may be initiated through an input 98 on the display (or associated with the display 98 (either on the machine or remote from the machine) and communicate with the controller 90. In conjunction with the zero functionality, a temporary zero function may be available to maintain in memory that a reference position of the elongate member 1000, such that a change in the payout length of the elongate member 1000 from the reference position may be calculated and monitored (in addition to the total payout length).

In some embodiments, the display 92 may be configured to display payout length in different units, such as feet, meters, or other desired lengths, which may be controlled by an input 96 upon the display 98.

In some embodiments, the sensor 50 and other components such as the gearbox 30 and the input 20 may be disposed within a housing 60. The housing 60 may be provided to enclose the sensor 50 and neighboring components, such as to maintain a waterproof environment for these components and to avoid foreign materials from entering this volume and thereby preventing interference with the operation of the sensor 50 based thereupon.

While the preferred embodiments of the disclosed have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

The invention claimed is:

1. A system for paying out and withdrawing an elongate member, comprising:

a rotatable reel that is configured to receive and retain a length of a flexible elongate member in a coiled fashion thereon, wherein rotation of the reel causes the flexible elongate member to be either payed out from the reel or withdrawn toward the reel, depending upon a direction of rotation of the reel;

a torque input configured to selectively transmit torque to the reel to urge rotation of the reel;

a transmission in operative connection between the torque input and reel, the transmission is configured to transfer torque from the torque input to the reel;

a sensor operatively engaged with the reel, the sensor being configured to sense movement of the reel and generate a signal representative of the sensed movement of the reel, wherein the transmission is operatively engaged with a sensor input and the sensor meshinqly enqaqes with the sensor input, such that the signal is generated based upon movement of the sensor input as urged by the transmission; and a controller that is configured to receive the signal from the sensor, the controller generates information for a display to indicate a length of the elongate member that is payed out from the reel.

2. The system of claim 1, wherein the sensor is an encoder that includes a first portion that rotates with rotation of the sensor input, and a second portion that is fixed and senses rotation of the first portion with respect to the second portion.

3. The system of claim 1 wherein the sensor input is disposed along a longitudinal axis, and the sensor is rotatably disposed upon an axis perpendicular to the longitudinal axis.

4. The system of claim 1, wherein the sensor is disposed in a water-tight enclosure.

5. The system of claim 1, further comprising a display, which is operated by the controller and provides a visual indication of the length of hose that is payed out from the reel.

6. The system of claim 5, wherein the display is disposed remotely from the controller.

7. The system of claim 6, wherein the display is not directly connected to a unit that supports the reel, wherein the display is configured to communicate with the controller via a wireless network.

8. The system of claim 5, wherein the display is provided upon the unit proximate to one or more controls to allow the user to operate the unit.

9. The system of claim 1, wherein the transmission is connected to the sensor input with an endless member that moves in conjunction with rotation of the reel, wherein the sensor is operatively engaged with the sensor input such that movement of the endless member urges rotation of the sensor input.

10. The system of claim 1, further comprising a storage component that is configured to retain parameters related to the elongate member disposed upon the reel.

11. The system of claim 10, wherein the storage component comprises one or more DIP switches, wherein the controller is configured to calculate the length of the elongate member payed out from the reel based upon the position of the one or more DIP switches.

12. The system of claim 1, wherein the torque input is a motor.

13. The system of claim 1, wherein the torque input is a hand crank.

* * * * *